US008601932B1

(12) United States Patent
Karfiol et al.

(10) Patent No.: US 8,601,932 B1
(45) Date of Patent: Dec. 10, 2013

(54) TRIGGER BAR CAM FOR SEAR DISCONNECT FOR A SEMI-AUTOMATIC PISTOL

(75) Inventors: Yury Karfiol, Brooklyn, NY (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 28 days.

(21) Appl. No.: 13/019,616

(22) Filed: Feb. 2, 2011

(51) Int. Cl.
*F41C 3/00* (2006.01)

(52) U.S. Cl.
USPC ..... 89/144; 89/145; 42/69.02

(58) Field of Classification Search
USPC ..... 42/14, 15, 16, 69.01, 69.02; 89/144, 89/145
See application file for complete search history.

(56) References Cited

U.S. PATENT DOCUMENTS

| | | | | |
|---|---|---|---|---|
| 4,577,430 | A | 3/1986 | Ruger et al. | |
| 7,194,833 | B1 * | 3/2007 | Curry | 42/14 |
| 2011/0289811 | A1 * | 12/2011 | Gentilini et al. | 42/69.02 |

* cited by examiner

*Primary Examiner* — Gabriel Klein
(74) *Attorney, Agent, or Firm* — Caesar, Rivise, Bernstein, Cohen & Pokotilow, Ltd.

(57) ABSTRACT

A semi-automatic pistol is provided having a frame, a slide and an arced cam surface extending longitudinally on an inner surface of the slide. The pistol has a barrel mounted between the frame and the slide, and a firing pin mechanism mounted in the slide. A trigger is mounted on the frame. A trigger bar and a sear are also provided. The trigger bar includes a generally planar surface extending between the ends of the trigger bar. The first end is connected to the trigger and the second end has a sear disconnect surface to engage and disengage a sear rotatably disposed in the frame that engages an end of the firing pin. A tab is disposed at an angle to the generally planar surface, where the tab has a top curved surface to slide along the arced cam surface of the slide as the slide moves.

2 Claims, 9 Drawing Sheets

TRIGGER BAR CAM FOR SEAR DISCONNECT FOR A SEMI-AUTOMATIC PISTOL

BACKGROUND OF THE INVENTION

The present invention is directed to semi-automatic pistols. More particularly, the present invention is directed to a feature of a trigger bar for a semi-automatic pistol that provides for optimal timing of sear disconnection during a firing sequence.

In certain prior art automatic pistols, an thin upper portion of a stamped trigger bar of a semi-automatic pistol rides in an arced cam surface extending longitudinally on an inner surface of the slide adjacent to a side edge of the slide. It would be highly desirable to provide improved smooth and timely sear disconnection utilizing the trigger bar of a semi-automatic pistol and, subsequently smooth and reliable resetting of the various firing elements of an the semi-automatic pistol during a firing sequence. The present invention is directed to a modification of a portion of the trigger bar of an automatic pistol to provide improved operation.

BRIEF SUMMARY OF THE INVENTION

The present invention is directed to a semi-automatic pistol having a frame, a slide having a first end and a second end and an arced cam surface extending longitudinally on an inner surface of the slide adjacent to a side edge of the slide. A barrel is mounted between the frame and the slide. A firing pin mechanism is mounted in the slide, where the firing pin mechanism includes a firing pin, a trigger mounted on the frame, a trigger bar, and a sear. The trigger bar includes a first end and a second end with a generally planar surface extending from the second end toward the first end. The first end is connected to the trigger. The second end has a sear disconnect surface to engage and disengage a sear rotatably disposed on the frame that engages an end of the firing pin. A tab is disposed at an angle to the generally planar surface, where the tab has a top curved surface adapted to slide along the arced cam surface of the slide as the slide moves from a battery position to a fully retracted position and back to the battery position. The top curved surface of the tab of the trigger bar is preferably ski-shaped.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments but it should be understood that the present invention is not deemed to be limited thereto.

Figure 1:
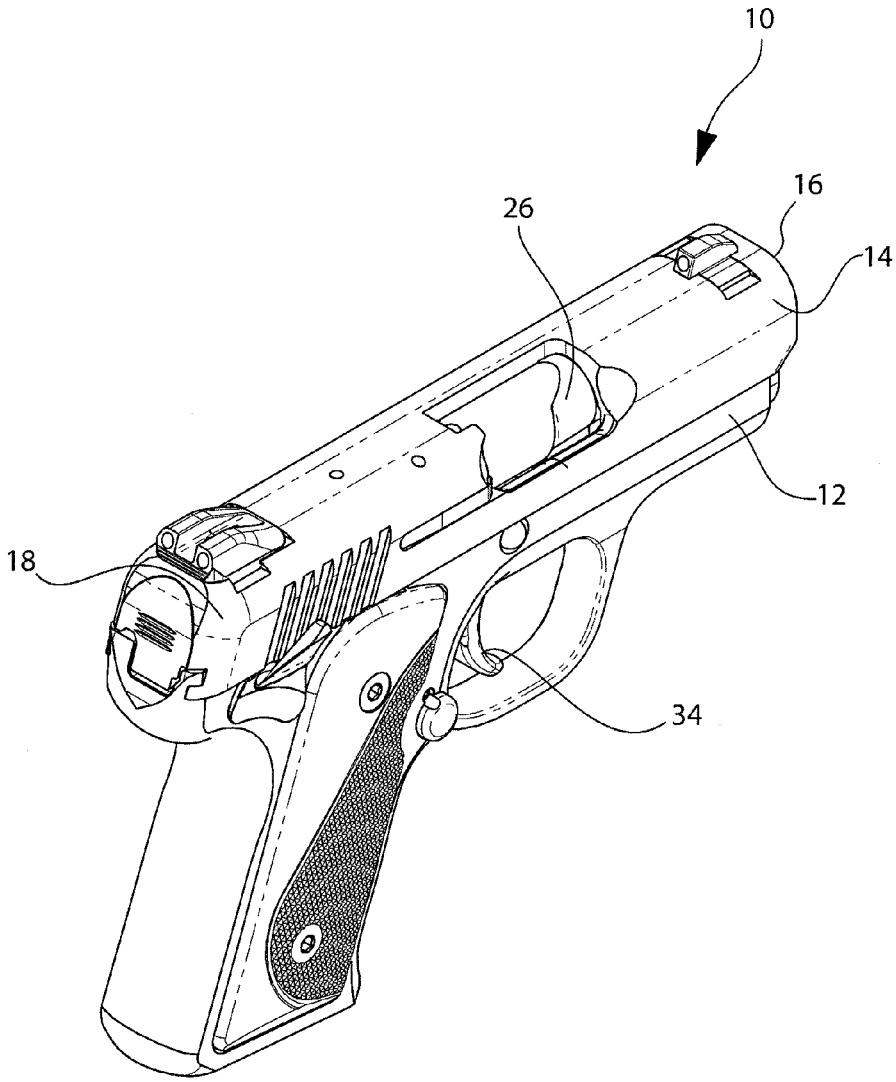
FIG. 1 is an isometric view of a semi-automatic pistol having a trigger bar cam in accordance with a preferred embodiment of the present invention.
Figure 2:
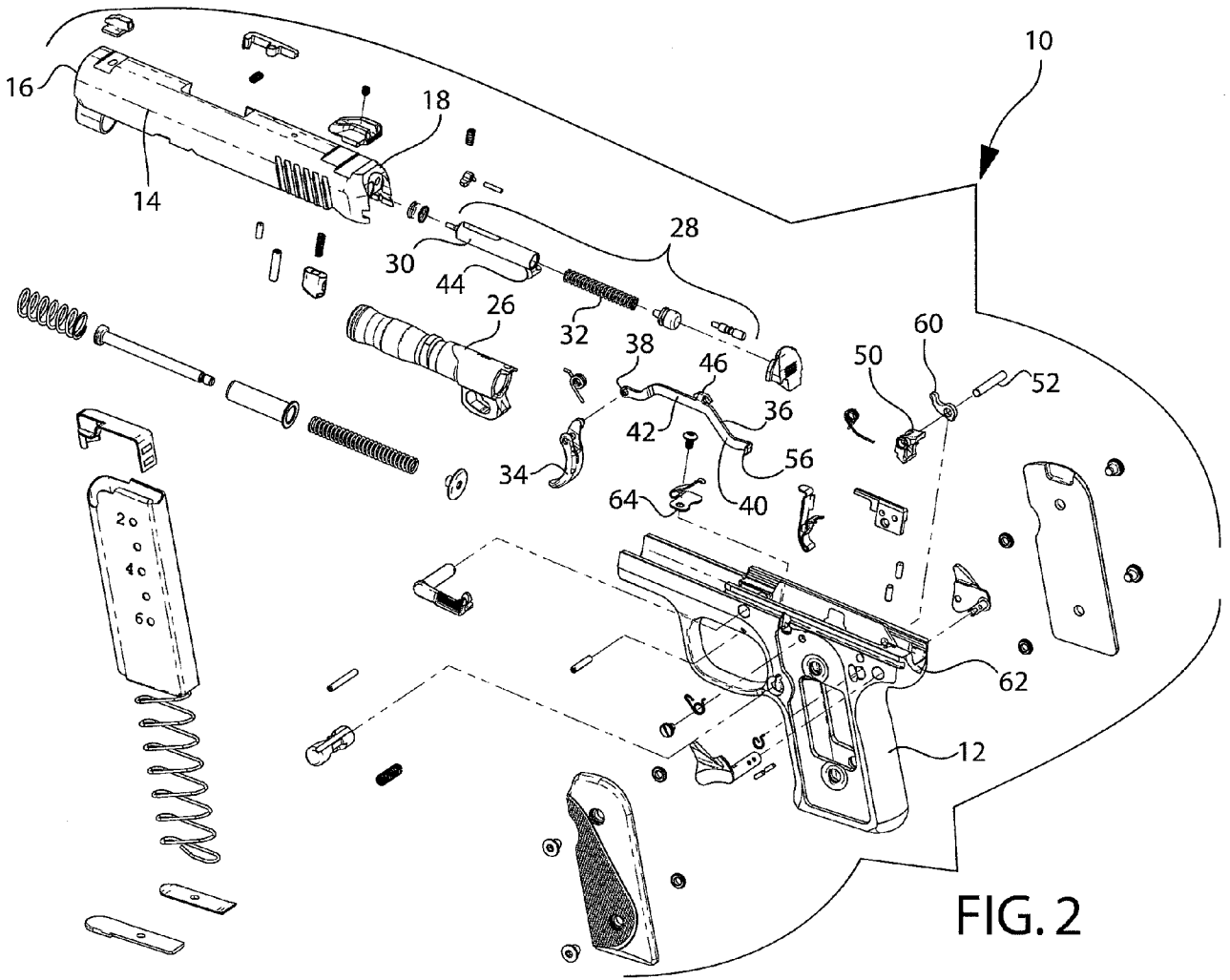
FIG. 2 is an exploded isometric view of the semi-automatic pistol having a trigger bar cam of FIG. 1.

Referring now to the drawing figures wherein like part numbers refer to like elements throughout the several views, there is shown in FIGS. 1 and 2 a semi-automatic pistol 10 having a unique trigger bar cam in accordance with a preferred embodiment of the present invention. As can be seen in FIGS. 1 and 2, the semi-automatic pistol 10 has a frame 12, a slide 14 having a first end 16 and a second end 18 and a magazine 25. The slide 14 has an arced cam surface 20 extending longitudinally on an inner surface 22 of the slide 14 adjacent to a side edge 24 of the slide 14 as is known. The pistol 10 has a barrel 26 mounted between the frame 12 and the slide 14, and a firing pin mechanism 28 mounted in the slide 14, as is well known. Specifically, the firing pin mechanism 28 includes a firing pin 30 and associated firing pin spring 32 and related elements. The pistol further includes a trigger 34 mounted on the frame 12, an attached trigger bar 36, and a pivotally mounted sear 50.

Figure 3:
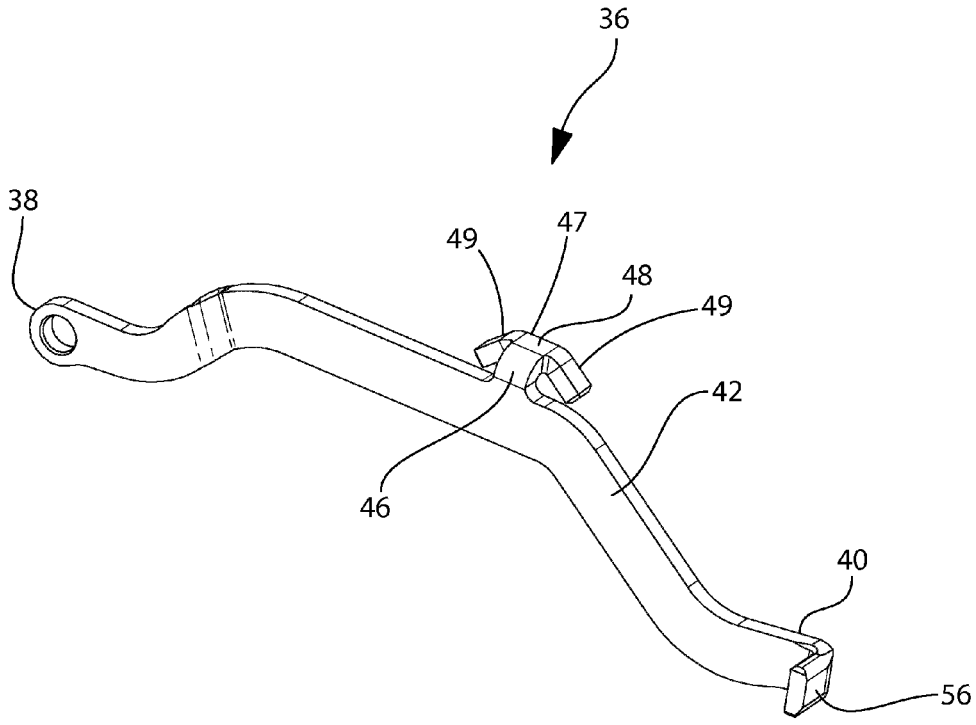
FIG. 3 is an isometric view of a trigger bar having the trigger bar cam for the semi-automatic pistol of FIG. 1.
Figure 4:
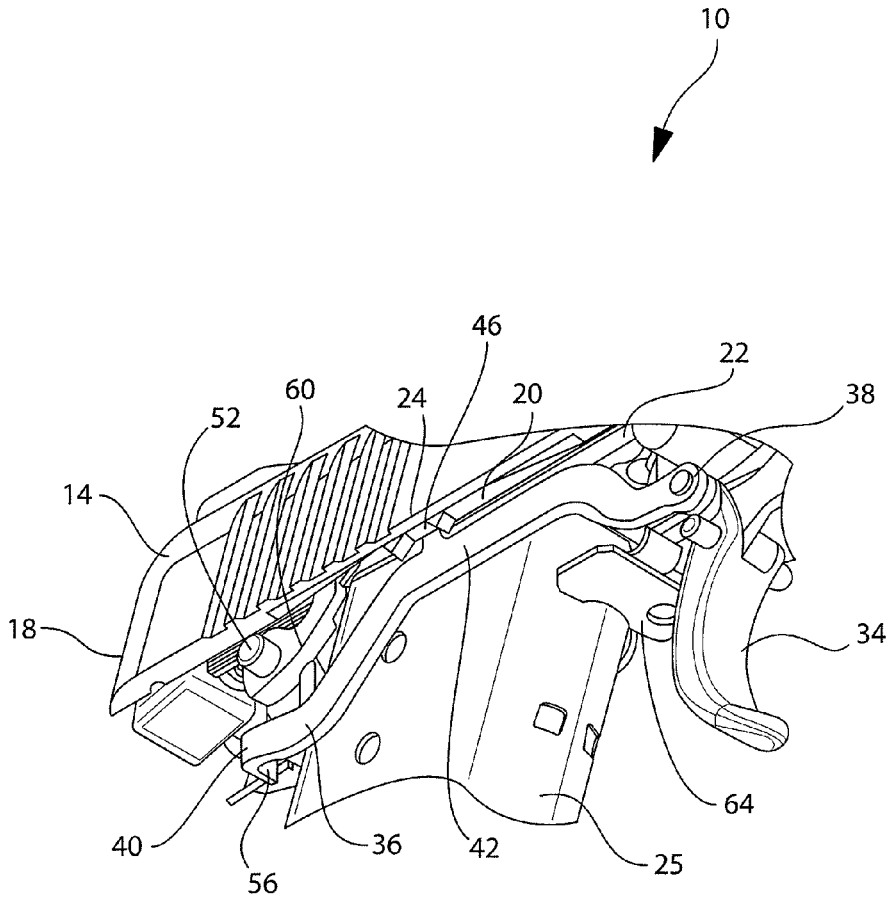
FIG. 4 is a partial, isometric view of the semi-automatic pistol having a trigger bar cam of FIG. 1, shown without the frame of the semi-automatic pistol for clarity.
Figure 5:
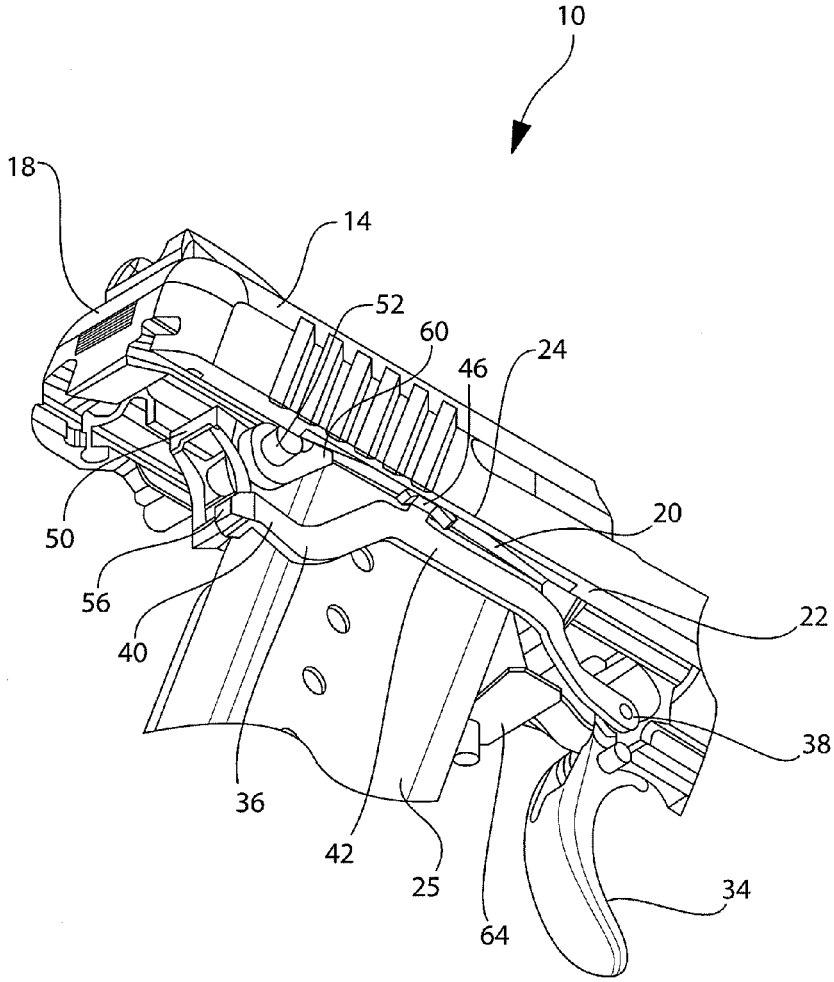
FIG. 5 is another partial, isometric view of the semi-automatic pistol having a trigger bar cam of FIG. 1, shown without the frame of the semi-automatic pistol for clarity.
Figure 7:
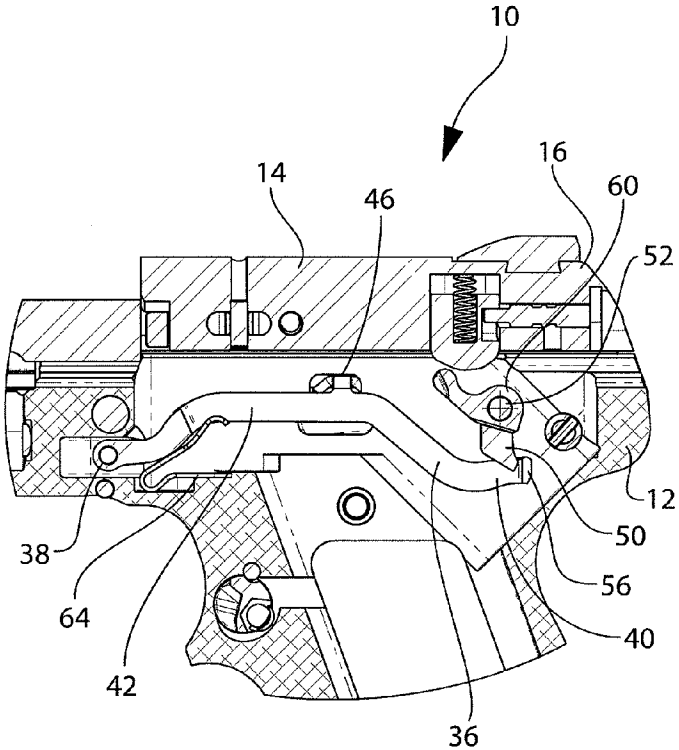
FIG. 7 is a partial side, cross-sectional view of the semi-automatic pistol having the trigger bar of FIG. 1, taken substantially along lines VII- - VII of FIG. 6.
Figure 6:
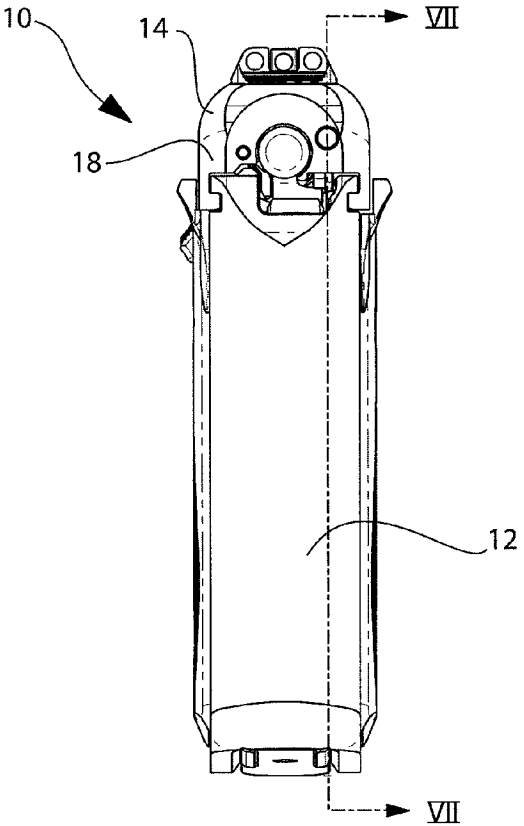
FIG. 6 is a rear, cross-sectional view of the semi-automatic pistol having the trigger bar cam of FIG. 1.
Figure 8:
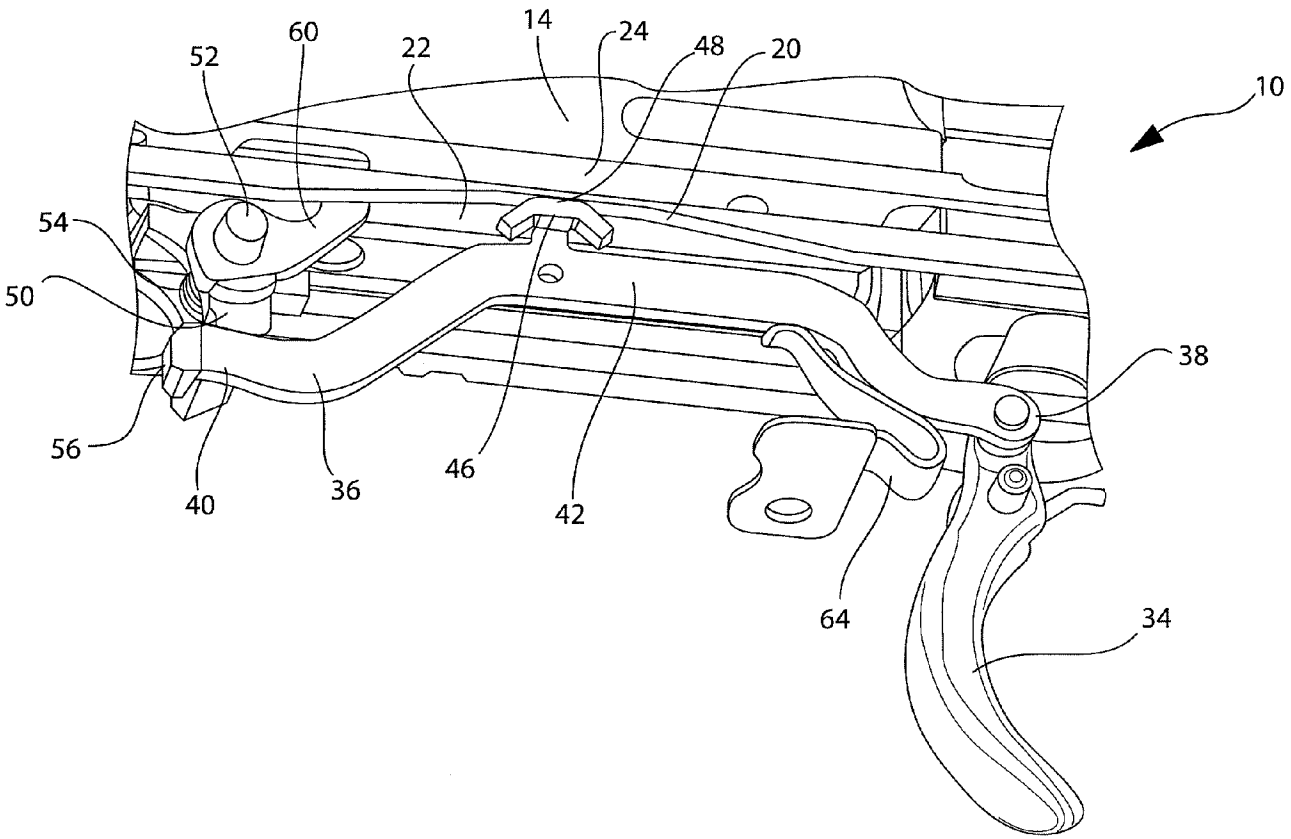
FIG. 8 is a simplified partial, isometric view of the semi-automatic pistol having a trigger bar cam of FIG. 1, shown without the frame of the semi-automatic pistol for clarity.
Figure 9:
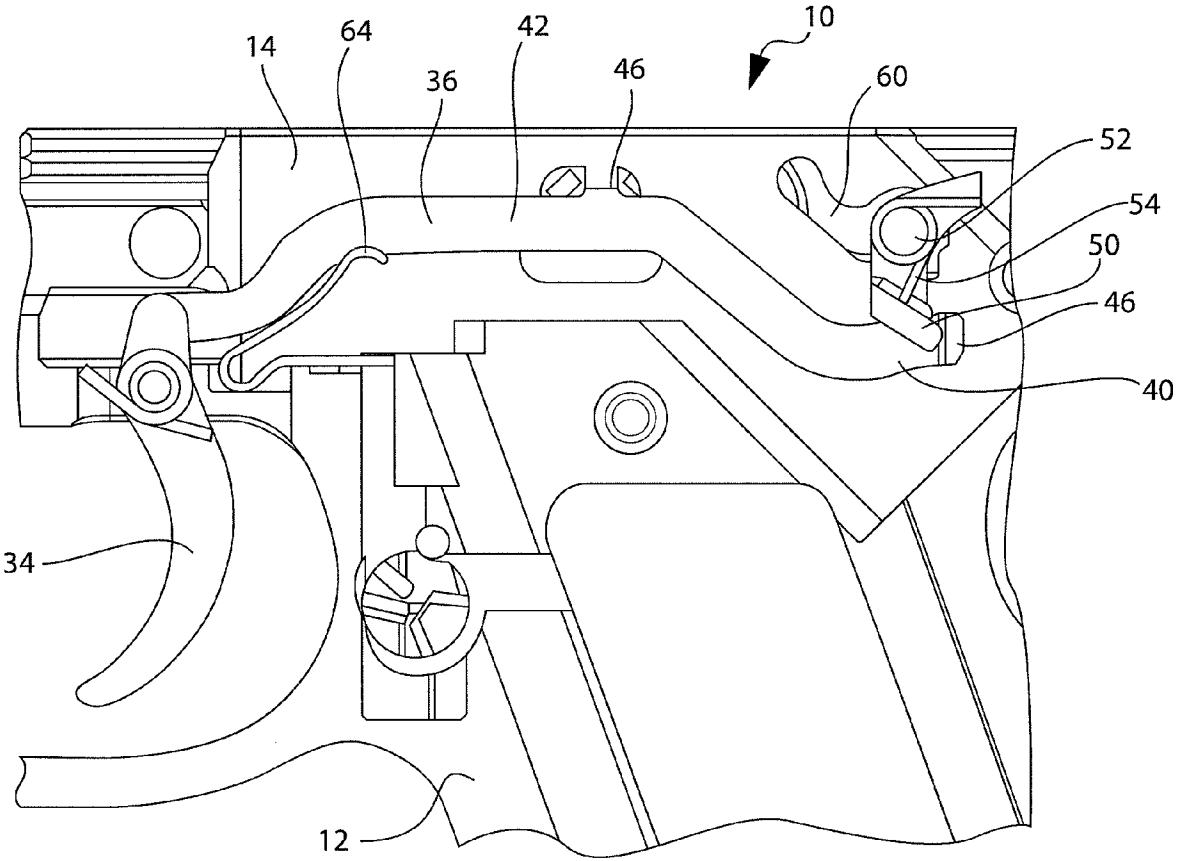
FIG. 9 is a simplified, partial side, cross-sectional view of the semi-automatic pistol having the trigger bar of FIG. 1.
Figure 10:
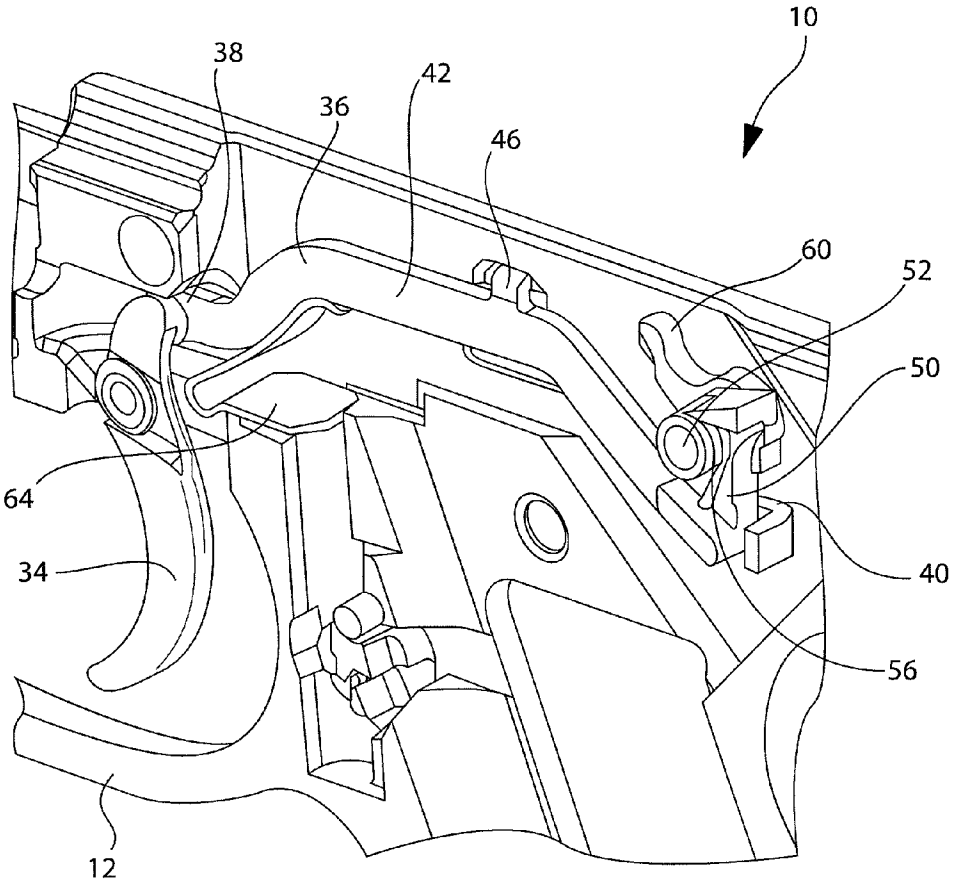
FIG. 10 is another partial, isometric view of the semi-automatic pistol having a trigger bar cam of FIG. 1.

As best seen in FIG. 3, the trigger bar 36 has a first end 38 and a second end 40 with a generally planar surface 42 extending between from the second end 40 toward the first end 38. The first end 38 is pivotally connected to the trigger 34. The second end 40 of the trigger bar 36 has a sear disconnect surface 56 to engage and disengage the pivotally mounted sear 50 located between the sear disconnect surface 56 of the trigger bar and a nose 44 (or lug) at the rear end of the firing pin 30 (i.e., striker). The sear 50 is pivotally mounted in a sear pin aperture 62 in the frame 12 on a sear pin 52 about which is a sear spring 54 to rotationally bias the sear. Also connected to the sear pin 52 is a safety striker lever 60. A trigger bar spring 64, mounted in the frame 12, biases the trigger bar 36 in an upward direction toward the slide 14.

A tab 46 is disposed on the trigger bar 36 at an angle to the generally planar surface 42. The tab 46 has a central portion 47 and two legs 49, each leg cantilevered and curved downwardly from the central portion in direction away from the slide 14. The tab 46 has a top curved surface 48, defined by the central portion 47 and the two legs 49, that slides along the arced cam surface 20 of the slide 14 as the slide 14 moves from a battery position to a fully retracted position and back to the battery position during a firing sequence of the automatic pistol 10.

The curved surface 48 that contacts the arced cam surface on the slide 13 provides an optimal variable breaking force during movement of the slide 14 from its retracted position to battery position. Initial upward force to the trigger bar 36 is provided by the trigger bar spring 64.

While the invention has been described in detail and with reference to specific embodiments thereof, it will be apparent to one skilled in the art that various changes and modifications can be made therein without departing from the spirit and scope thereof.

What is claimed is:

1. A semi-automatic pistol having a frame, a slide having a first end and a second end and an arced cam surface extending longitudinally on an inner surface of the slide integral to a side edge of the slide, a barrel mounted between the frame and the slide, a firing pin mechanism mounted in the slide, the firing pin mechanism having a firing pin, a trigger mounted on the frame, a trigger bar, and a sear, the trigger bar comprising:

(a) a first end and a second end with a planar surface extending from the second end toward the first end, said planar surface being perpendicular to an axis of rotation of the trigger;

(b) the first end connected to the trigger;

(c) the second end having a sear disconnect surface to engage and disengage a sear rotatably disposed on the frame that engages an end of the firing pin; and (d) a tab disposed at an angle to and non-coplanar with said planar surface, said tab having a central portion and two legs, each leg cantilevered and curved downwardly from the central portion in a direction away from the slide, said tab having a top curved surface defined by the central portion and the two legs, the top curved surface being adapted to slide along the arced cam surface of the slide as the slide moves from a battery position to a fully retracted position and back to the battery position.

2. A semi-automatic pistol having a frame, a slide having a first end and a second end and an arced cam surface extending longitudinally on an inner surface of the slide integral to a side edge of the slide, a barrel mounted between the frame and the slide, a firing pin mechanism mounted in the slide, the firing pin mechanism having a firing pin, a trigger mounted on the frame, a trigger bar, and a sear, the trigger bar comprising:

(a) a first end and a second end with a planar surface extending from the second end toward the first end, said planar surface being perpendicular to an axis of rotation of the trigger;

(b) the first end connected to the trigger;

(c) the second end having a sear disconnect surface to engage and disengage a sear rotatably disposed on the frame that engages an end of the firing pin; and (d) a tab disposed at a right angle to said planar surface, said tab having a central portion and two legs, each leg cantilevered and curved downwardly from the central portion in a direction away from the slide, said tab having a top curved surface defined by the central portion and the two legs, the top curved surface being adapted to slide along the arced cam surface of the slide as the slide moves from a battery position to a fully retracted position and back to the battery position.

* * * * *